US011668126B2

(12) United States Patent
Storck, III et al.

(10) Patent No.: US 11,668,126 B2
(45) Date of Patent: Jun. 6, 2023

(54) INDEXING MULTI-PANEL DOOR

(71) Applicant: GM Global Technology Operations LLC, Detroit, MI (US)

(72) Inventors: Phillip C. Storck, III, Washington, MI (US); Besi Rrumbullaku, Rochester, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 112 days.

(21) Appl. No.: 17/470,623

(22) Filed: Sep. 9, 2021

(65) Prior Publication Data

US 2023/0073836 A1 Mar. 9, 2023

(51) Int. Cl.
*E05D 15/06* (2006.01)
*E06B 3/46* (2006.01)
*E06B 3/92* (2006.01)

(52) U.S. Cl.
CPC ..... *E05D 15/0652* (2013.01); *E05D 15/063* (2013.01); *E06B 3/4636* (2013.01); *E06B 3/922* (2013.01); *E05Y 2201/684* (2013.01); *E05Y 2201/688* (2013.01); *E05Y 2900/132* (2013.01)

(58) Field of Classification Search
CPC ..... E05D 15/0652; E05D 15/063; E05D 15/1065; E05D 15/0643; E05D 2015/1052; E06B 3/922
USPC ..... 49/100, 125; 160/222
See application file for complete search history.

(56) References Cited

U.S. PATENT DOCUMENTS 3,138,830 A * 6/1964 Scharge ..... E05D 15/066 49/420
3,510,983 A * 5/1970 Barabas ..... E05D 15/1065 49/130
7,174,944 B1 * 2/2007 Clark ..... E05D 15/08 49/424
7,299,852 B1 * 11/2007 Chuang ..... A47H 23/04 160/222
8,297,334 B2 * 10/2012 Chu ..... E06B 9/36 160/202

* cited by examiner

*Primary Examiner* — Marcus Menezes
(74) *Attorney, Agent, or Firm* — Vivacqua Crane, PLLC

(57) ABSTRACT

An indexing multi-panel door includes a leading door panel supported on a first track and moveable between open and closed positions, a trailing door panel supported on a second track and moveable between open and closed positions, a motion control track mounted to one of the door panels, a follower mounted to the other one of the door panels, the follower including a first distal end received within the motion control track, the motion control track including features to frictionally engage the first distal end, wherein when the leading door is moved between the open and closed positions, engagement between the first distal end and the features moves the trailing door panel along with the leading door panel, and allows slippage, wherein the leading and trailing door panels move relative to one another as the leading and trailing door panels are moved between the open and closed positions.

20 Claims, 4 Drawing Sheets

INDEXING MULTI-PANEL DOOR

INTRODUCTION

The present disclosure relates to a multi-panel door. More specifically, the present disclosure is related to motion control of individual door panels of a multi-panel door relative to one another.

In many multi-panel doors, when a leading door is moved toward an open or closed position, a trailing door remains stationary until the leading door impacts the trailing door and either pushes or pulls the trailing door along with it. This can result in additional noise.

Thus, while current multi-panel doors achieve their intended purpose, there is a need for a new and improved multi-panel door that provides motion control of a leading door panel relative to a trailing door panel as the leading door panel and trailing door panel are moved back and forth between open and closed positions.

SUMMARY

According to several aspects of the present disclosure, an indexing multi-panel door includes a leading door panel slidingly supported on a first track and moveable between an open position and a closed position, a trailing door panel slidingly supported on a second track and moveable between an open position and a closed position, a motion control track mounted to one of the leading door panel and the trailing door panel, a follower mounted to and extending laterally from the other one of the leading door panel and the trailing door panel, the follower including a first distal end that is received within the motion control track, wherein the motion control track includes features adapted to frictionally engage the first distal end of the follower, wherein when the leading door is moved back and forth between the open position and the closed position, frictional engagement between the first distal end of the follower and features within the motion control track simultaneously moves the trailing door back and forth between the open and closed positions along with the leading door panel, and allows slippage between the first distal end of the follower and the features within the motion control track, wherein the leading door panel and the trailing door panel move relative to one another as the leading door panel and the trailing door panel are moved back and forth between the open and closed positions.

According to several aspects of the present disclosure, an indexing multi-panel door includes a leading door panel slidingly supported on a first track and moveable between an open position and a closed position, a trailing door panel slidingly supported on a second track and moveable between an open position and a closed position, a motion control track mounted to one of the leading door panel and the trailing door panel, the motion control track including an opening track and a closing track, a follower mounted to and extending laterally from the other one of the leading door panel and the trailing door panel, the follower including a first distal end that is received within the opening track of the motion control track during opening of the leading door panel and the trailing door panel, and is received within the closing track of the motion control track during closing of the leading door panel and the trailing door panel, each of the opening track and the closing track including features adapted to frictionally engage the first distal end of the follower, wherein when the leading door is moved back and forth between the open position and the closed position, frictional engagement between the first distal end of the follower and features within the motion control track simultaneously moves the trailing door back and forth between the open and closed positions along with the leading door panel, and allows slippage between the first distal end of the follower and the features within the opening track and the closing track, wherein the leading door panel and the trailing door panel move relative to one another as the leading door panel and the trailing door panel are moved back and forth between the open and closed positions.

According to another aspect, the follower includes an over-center feature adapted to allow the first distal end of the follower to toggle from the closing track to the opening track when the leading door panel and the trailing door panel are completely closed, keep the first distal end of the follower engaged with the opening track during opening of the leading door panel and the trailing door panel, allow the first distal end of the follower to toggle from the opening track to the closing track when the leading door panel and the trailing door panel are completely open, and keep the first distal end of the follower engaged with the closing track during closing of the leading door panel and the trailing door panel.

According to another aspect, the opening track and the closing track are parallel to and adjacent one another, the closing track including a first ramped surface that forces the first distal end of the follower to toggle to the opening track when the leading door panel and the trailing door panel are moved to the closed position, and the opening track including a second ramped surface that forces the first distal end of the follower to toggle to the closing track when the leading door panel and the trailing door panel are moved to the open position.

According to another aspect, the first distal end of the follower includes a spring biased roller ball, wherein the roller ball is spring biased laterally outward toward the motion control track.

According to another aspect, the motion control track includes a lateral facing friction surface, the spring biased roller ball of the first distal end of the follower engaging the friction surface and sliding across the friction surface as the leading door panel and the trailing door panel move relative to one another, the spring bias of the roller ball pushing the roller ball against the friction surface of the motion control track.

According to another aspect, the features within the motion control track comprise at least one section of the friction surface within the opening track that extends laterally outward toward the follower and at least one section of the friction surface within the closing track that extends laterally outward toward the follower, wherein when the first distal end of the follower slides across the at least one section of the friction surface within the opening track, the spring biased roller ball is pushed laterally against the biasing force of the spring, increasing the force that the spring bias of the roller ball pushes the roller ball against the friction surface of the opening track and reducing the amount of slippage between the follower and the motion control track and the movement of the leading door panel and the trailing door panel relative to one another as the leading door panel and the trailing door panel move toward the open positions, and when the first distal end of the follower slides across the at least one section of the friction surface within the closing track, the spring biased roller ball is pushed laterally against the biasing force of the spring, increasing the force that the spring bias of the roller ball pushes the roller ball against the friction surface of the closing track and reducing the amount of slippage between the follower and the motion control track and the movement of the leading door panel and the trailing door panel relative to one another as the leading door panel and the trailing door panel move toward the closed positions.

According to another aspect, each of the at least one section of the friction surface within the opening track and each of the at least one section of the friction surface within the closing track is one of flat and extends laterally outward toward the follower a constant distance over an entire length and providing a constant frictional engagement over the entire length, and flat and ramped, extending laterally outward toward the follower a gradually varying distance over the entire length and providing a varying frictional engagement over the entire length.

According to another aspect, the at least one section of the friction surface within the opening track provides an opening profile for the leading door panel and the trailing door panel during opening of the leading door panel and the trailing door panel, and the at least one section of the friction surface within the closing track provides a closing profile for the leading door panel and the trailing door panel during closing of the leading door panel and the trailing door panel.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
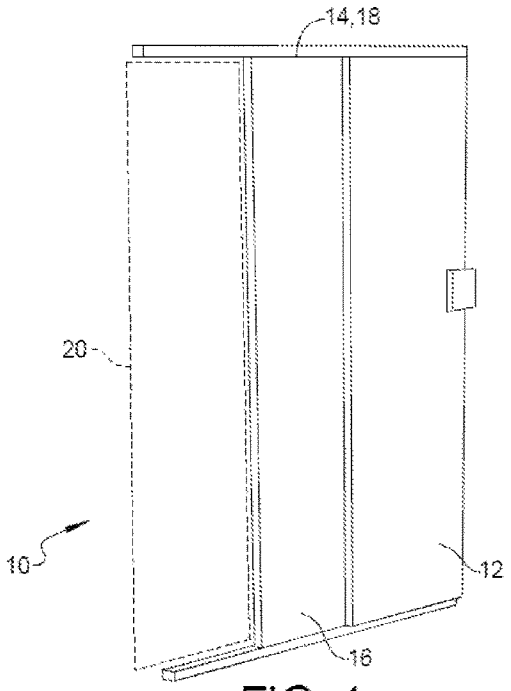
FIG. 1 is a perspective view of a multi-panel door according to an exemplary embodiment of the present disclosure.

Referring to FIG. 1, an indexing multi-panel door 10 in accordance with the present disclosure includes a leading door panel 12 slidingly supported on a first track 14 and moveable between an open position and a closed position and a trailing door panel 16 slidingly supported on a second track 18 and moveable between an open position and a closed position. The leading door panel 12 and the trailing door panel 16 are shown in FIG. 1 in the closed position, wherein the leading and trailing door panels 12, 16 extend across an opening. The leading and trailing door panels 12, 16 move along the first and second tracks 14, 18 and overlap one another in the open position, wherein the leading and trailing doors 12, 16 are positioned to one side of an opening, as shown in shadow at 20.

Figure 2:
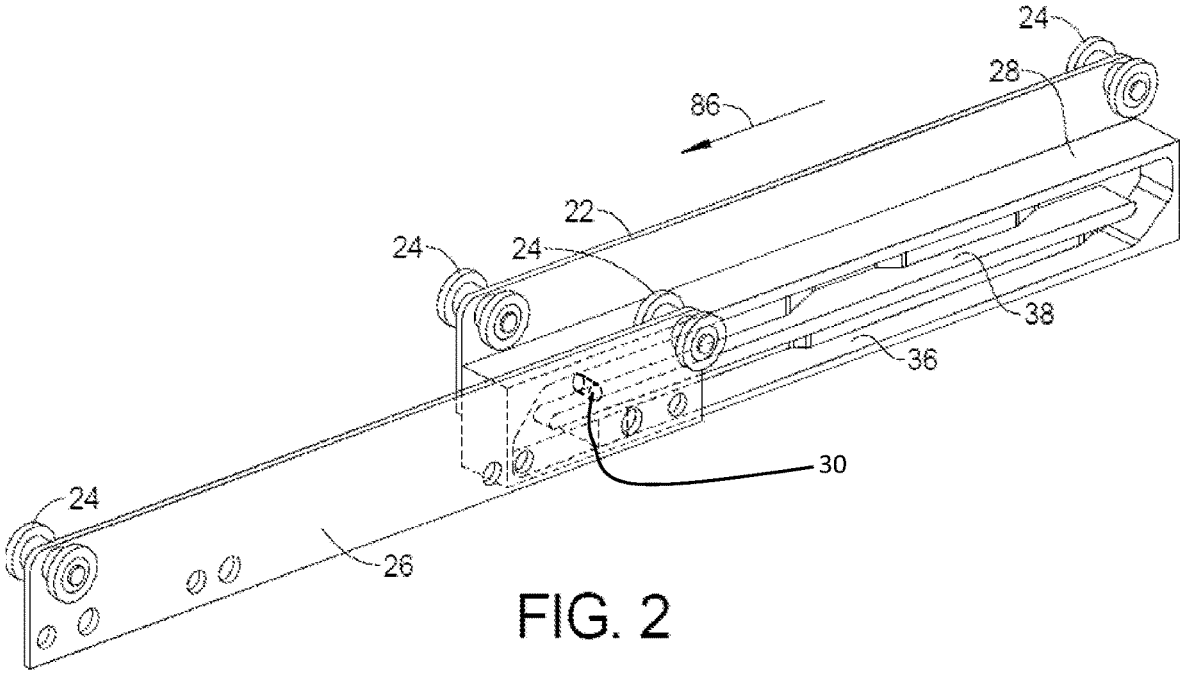
FIG. 2 is a perspective view of a leading support bracket and trailing support bracket for the multi-panel door of FIG. 1 in the closed position.
Figure 3:
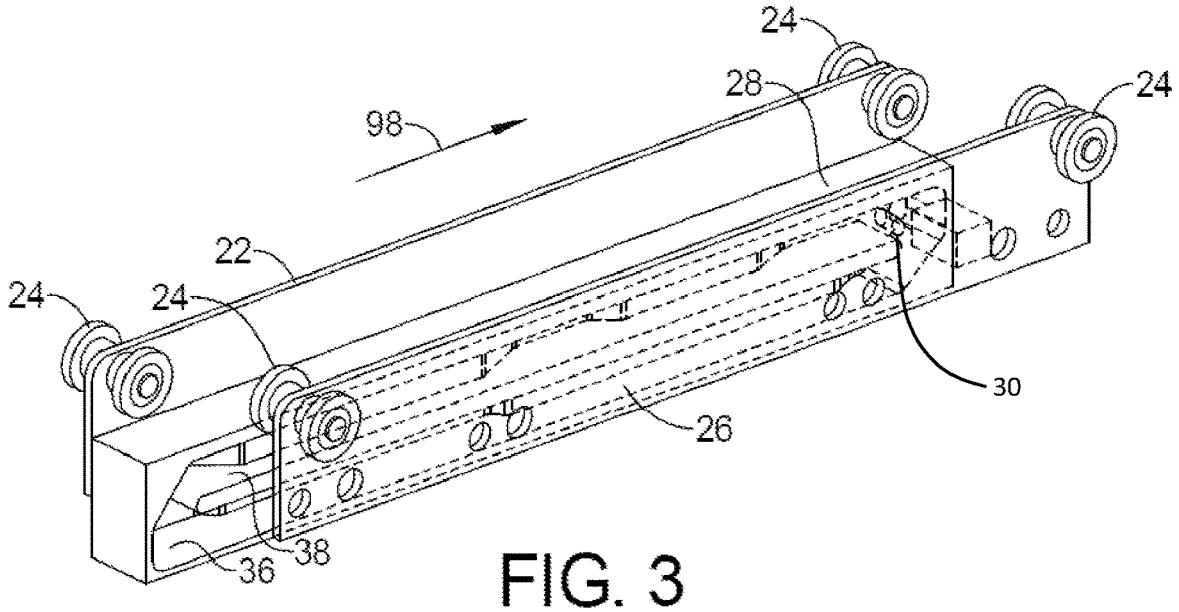
FIG. 3 is a perspective view of a leading support bracket and trailing support bracket for the multi-panel door of FIG. 1 in the open position.

Referring to FIG. 2, the leading door panel 12 includes a leading support bracket 22 that includes rollers 24 adapted to ride within the first track 14 allowing the leading door panel 12 to roll back and forth along the first track 14 between the open position and the closed position. The trailing door panel 16 includes a trailing support bracket 26 that includes rollers 24 adapted to ride within the second track 18 allowing the trailing door panel 16 to roll back and forth along the second track 18 between the open position and the closed position. In FIG. 2, the leading support bracket 22 and the trailing support bracket 26 are shown in the completely closed position, with the leading door panel 12 and trailing door panel 16 removed. Referring to FIG. 3, the leading support bracket 22 and the trailing support bracket 26 are shown in the completely open position, with the leading door panel 12 and trailing door panel 16 removed.

A motion control track 28 is mounted to one of the leading door panel 12 and the trailing door panel 16. As shown in FIG. 2 and FIG. 3, the motion control track 28 is mounted onto the leading support bracket 22 for the leading door panel 12. A follower 30 is mounted to and extends laterally from the other one of the leading door panel 12 and the trailing door panel 16. As shown in FIG. 2 and FIG. 3, the follower 30 is mounted onto the trailing support bracket 26 for the trailing door panel 16. It should be understood that the motion control track 28 may be mounted onto the leading support bracket 22 and the follower 30 mounted onto the trailing support bracket 26, as shown in FIG. 2 and FIG. 3, or alternatively, the motion control track 28 may be mounted onto the trailing support bracket 26 and the follower 30 mounted onto the leading support bracket 22 without departing from the scope of the present disclosure.

The follower 30 includes a first distal end 32 that is received within the motion control track 28. The motion control track 28 includes features 34 adapted to frictionally engage the first distal end 32 of the follower 30. When the leading door panel 12 is moved back and forth between the open position and the closed position, frictional engagement between the first distal end 32 of the follower 30 and the features 34 within the motion control track 28 simultaneously moves the trailing door panel 16 back and forth between the open and closed positions along with the leading door panel 12, and allows slippage between the first distal end 32 of the follower 30 and the features 34 within the motion control track 28, wherein the leading door panel 12 and the trailing door panel 16 move relative to one another as the leading door panel 12 and the trailing door panel 16 are moved back and forth between the open and closed positions. The frictional engagement between the first distal end 32 of the follower 30 and the features 34 within the motion control track 28 provide sufficient friction to cause motion of the leading door panel 12 to be transferred to the trailing door panel 16 while simultaneously allowing slippage between the first distal end 32 of the follower 30 and the motion control track 28 so the trailing door panel 16 moves at a different speed than the leading door panel 12.

The features 34 of the motion control track 28 provide varying amounts of frictional engagement between the first distal end 32 of the follower 30 and the motion control track 28 to allow movement of the trailing door panel 16 relative to the leading door panel 12 to be tuned to a specific profile as the leading door panel 12 and the trailing door panel 16 are moved back and forth between the open and closed positions.

Figure 4:
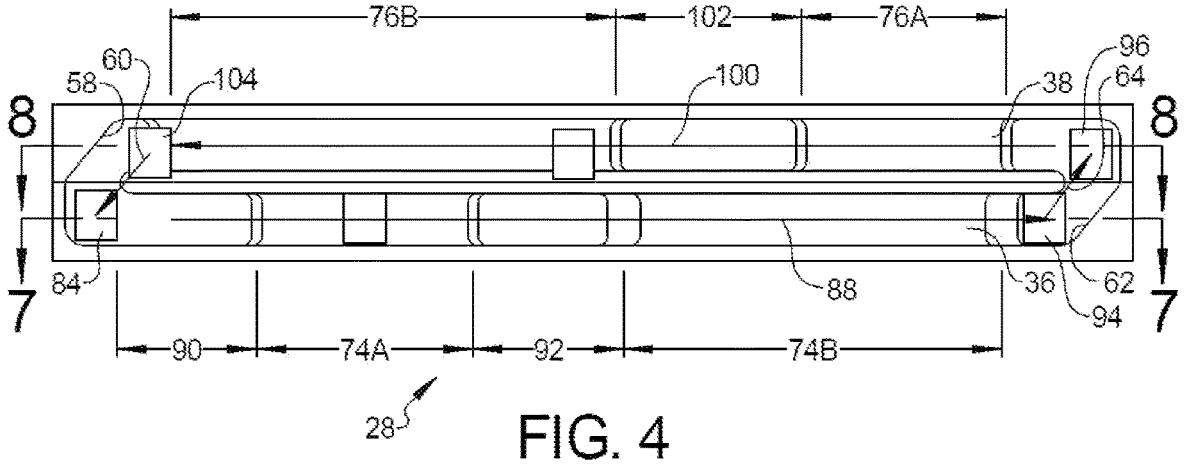
FIG. 4 is a side view of a motion control track for the multi-panel door shown in FIG. 1.

Referring to FIG. 4, in an exemplary embodiment, the motion control track 28 includes an opening track 36 and a closing track 38. Each of the opening track 36 and the closing track 38 includes features 34 adapted to frictionally engage the first distal end 32 of the follower 30.

Figure 5A:
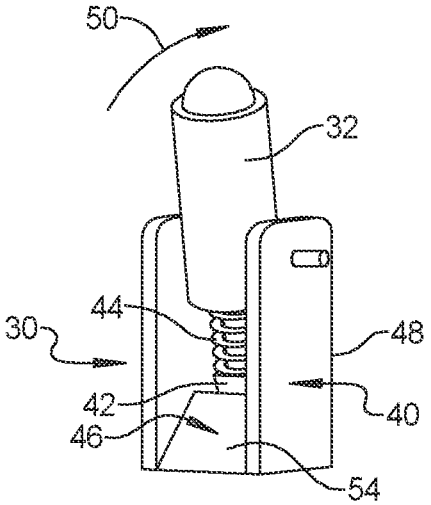
FIG. 5A is a perspective view of a follower wherein a over-center feature is positioned on a first side of a cam.
Figure 5B:
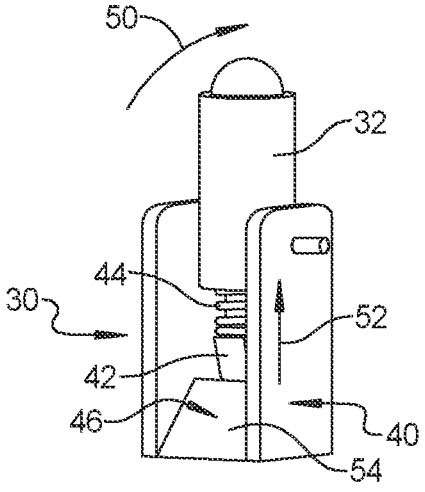
FIG. 5B is a perspective view of the follower of FIG. 5A wherein the over-center feature is positioned at a center point position.
Figure 5C:
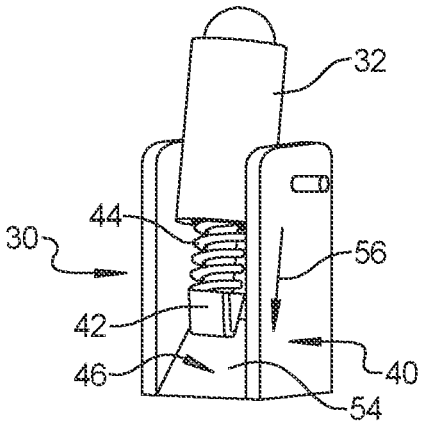
FIG. 5C is a perspective view of the follower of FIG. 5A wherein the over-center feature is positioned on a second side of the cam.

Referring to FIG. 5A, FIG. 5B and FIG. 5C, in an exemplary embodiment, the follower 30 includes an over-center feature 40. The over-center feature 40 allows the follower 30 to toggle back and forth from a first position, as shown in FIG. 5A, wherein the first distal end 32 of the follower 30 is aligned with the opening track 36, and a second position, as shown in FIG. 5C, wherein the first distal end 32 of the follower 30 is aligned with the closing track 38. The over-center feature 40 includes a latch member 42 that is biased by a latch spring 44 toward a cam 46. When the first distal end 32 of the follower 30 is in the first position, as shown in FIG. 5A, the latch member 42 is biased toward the cam 46 and positioned adjacent the cam 46 on a first side 48. To toggle the first distal end 32 of the follower 30 to the second position, as indicated by arrow 50, sufficient force must be applied to the first distal end 32 to force the latch member 42 to follow the surface of the cam 46 and compress the latch spring 44, as indicated by arrow 52. Once the first distal end 32 of the follower 30 reaches the center point, as shown in FIG. 5B, further movement of the first distal end 32 toward the second position, as indicated by arrow 50, will push the latch member 42 to a second side 54 of the cam 46, allowing the latch spring 44 to push the latch member 42 toward and adjacent to the cam 46, as indicated by arrow 56, and securing the first distal end 32 of the follower 30 in the second position, as shown in FIG. 5C The over-center feature 40 allows the first distal end 32 of the follower 30 to toggle from the closing track 38 to the opening track 36 when the leading door panel 12 and the trailing door panel 16 are completely closed and keeps the first distal end 32 of the follower 30 engaged with the opening track 36 during opening of the leading door panel 12 and the trailing door panel 16. Further, the over-center feature 40 allows the first distal end 32 of the follower 30 to toggle from the opening track 36 to the closing track 38 when the leading door panel 12 and the trailing door panel 16 are completely open, and keeps the first distal end 32 of the follower 30 engaged with the closing track 38 during closing of the leading door panel 12 and the trailing door panel 16.

Referring again to FIG. 4, the opening track 36 and the closing track 38 are parallel to and adjacent one another. The closing track 38 includes a first ramped surface 58 that forces the first distal end 32 of the follower 30 to toggle to the opening track 36 when the leading door panel 12 and the trailing door panel 16 are moved to the closed position, as indicated by arrow 60, and the opening track 36 includes a second ramped surface 62 that forces the first distal end 32 of the follower 30 to toggle to the closing track 38 when the leading door panel 12 and the trailing door panel 16 are moved to the open position, as indicated by arrow 64.

Figure 6:
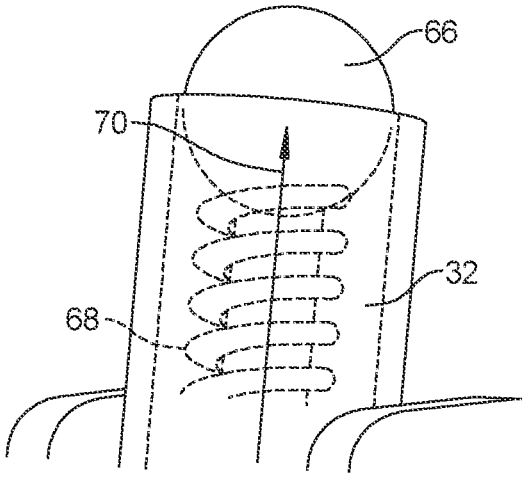
FIG. 6 is an enlarged view of a first distal end of the follower shown in FIG. 5A.

Referring to FIG. 6, the first distal end 32 of the follower 30 includes a spring biased roller ball 66. The roller ball 66 is biased laterally outward toward the motion control track 28 by a ball spring 68, as indicated by arrow 70. The motion control track 28 includes a lateral facing friction surface 72. The spring biased roller ball 66 of the first distal end 32 of the follower 30 engages the friction surface 72 and slides across the friction surface 72 as the leading door panel 12 and the trailing door panel 16 move relative to one another. The force of the ball spring 68 pushes the roller ball 66 against the friction surface 72 of the motion control track 28. The greater the force at which the roller ball 66 is pushed against the friction surface 72, the higher the resulting frictional resistance to slippage will be. If the force at which the roller ball 66 is pushed against the friction surface 72 is very high, the amount of slippage between the leading door panel 12 and the trailing door panel 16 will be low, and the leading door panel 12 and the trailing door panel 16 will move very little, or slowly, relative to one another. Alternatively, if the force at which the roller ball 66 is pushed against the friction surface 72 is very low, the amount of slippage between the leading door panel 12 and the trailing door panel 16 will be higher, and the leading door panel 12 and the trailing door panel 16 will move more freely relative to one another.

Figure 7:
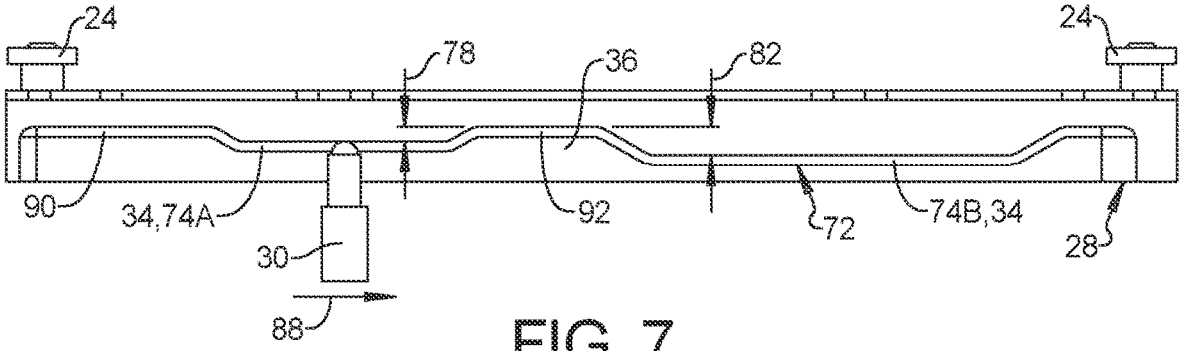
FIG. 7 is a sectional view of FIG. 4 taken along line 7-7 of FIG. 4.
Figure 8:
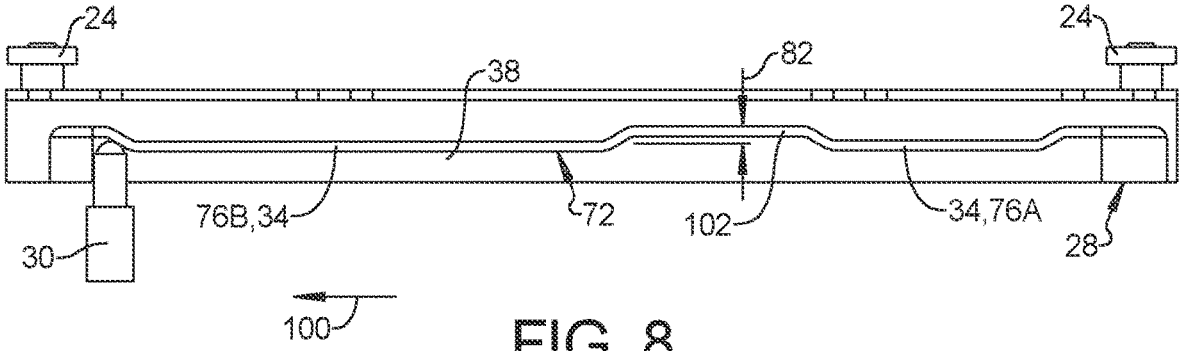
FIG. 8 is a sectional view of FIG. 4 taken along line 8-8 of FIG. 4.

Referring to FIG. 4 and FIG. 7, in an exemplary embodiment, the features 34 adapted to frictionally engage the first distal end 32 of the follower 30 include at least one section 74 of the friction surface 72 within the opening track 36 that extends laterally outward toward the follower 30. Referring to FIG. 4 and FIG. 8, the features 34 adapted to frictionally engage the first distal end 32 of the follower 30 include at least one section 76 of the friction surface 72 within the closing track 38 that extends laterally outward toward the follower 30.

When the first distal end 32 of the follower 30 slides across the at least one section 74 of the friction surface 72 within the opening track 36, the spring biased roller ball 66 is pushed laterally against the biasing force of the ball spring 68, compressing the ball spring 68 and increasing the force at which the roller ball 66 is pushed against the friction surface 72 of the opening track 36. This reduces the amount of slippage between the follower 30 and the motion control track 28 and the movement of the leading door panel 12 and the trailing door panel 16 relative to one another as the leading door panel 12 and the trailing door panel 16 move toward the open position.

Referring again to FIG. 4 and FIG. 7, in an exemplary embodiment the opening track 36 includes a first section 74A of the friction surface 72 within the opening track 36 that extends laterally outward toward the follower 30 and a second section 74B of the friction surface 72 within the opening track 36 that extends laterally outward toward the follower 30. The first section 74A extends laterally outward toward the follower 30 a first distance 78. The second section 74B extends laterally outward toward the follower 30 a second distance 80 that is greater than the first distance 78.

When the first distal end 32 of the follower 30 slides across the at least one section 76 of the friction surface 72 within the closing track 38, the spring biased roller ball 66 is pushed laterally against the biasing force of the ball spring 68, compressing the ball spring 68 and increasing the force at which the roller ball 66 is pushed against the friction surface 72 of the closing track 38. This reduces the amount of slippage between the follower 30 and the motion control track 28 and the movement of the leading door panel 12 and the trailing door panel 16 relative to one another as the leading door panel 12 and the trailing door panel 16 move toward the closed position.

Referring again to FIG. 4 and FIG. 8, in an exemplary embodiment the closing track 38 includes a third section 76A of the friction surface 72 within the closing track 38 that extends laterally outward toward the follower 30 and a fourth section 76B of the friction surface 72 within the closing track 38 that extends laterally outward toward the follower 30. The third and fourth sections 76A, 76B extend laterally outward toward the follower 30 a third distance 82.

Referring again to FIG. 2, when the leading door panel 12 and the trailing door panel 16 are in the fully closed position the first distal end 32 of the follower 30 is positioned within the opening track 36 of the motion control track 28 at a first position 84, as shown in FIG. 4. As the leading door panel 12 is moved toward the open position, as indicated by arrow 86, the leading door panel 12 moves relative to the trailing door panel 16. Referring to FIG. 4 and FIG. 7, as the leading door panel 12 moves relative to the trailing door panel 16 the first distal end 32 of the follower 30 moves within the opening track 36, as indicated by arrow 88. The first distal end 32 of the follower 30 first passes through a first flat zone 90, wherein the frictional engagement of the roller ball 66 within the follower 30 and the friction surface 72 of the motion control track 28 is very little, such that the trailing door panel 16 moves very little as the leading door panel 12 moves relative to the trailing door panel 16 toward the open position.

The first distal end 32 of the follower 30 then engages the first section 74A of the friction surface 72 within the opening track 36 that extends laterally outward toward the follower 30. The first section 74A extends laterally outward toward the follower 30 a first distance 78, and thus compresses the ball spring 68 and increases the frictional engagement between the roller ball 66 and the friction surface 72. The increased frictional force reduces the amount of slippage between the roller ball 66 and the friction surface 72 and causes the trailing door panel 16 to be pushed toward the open position by the leading door panel 12, as the leading door panel 12 moves toward the open position. There is still slippage, so there is still relative motion between the leading door panel 12 and the trailing door panel 16, however, the relative motion between the leading door panel 12 and the trailing door panel 16 is reduced as compared to the relative motion between the leading door panel 12 and the trailing door panel 16 as the follower 30 passed through the first flat zone 90.

The first distal end 32 of the follower 30 then passes through a second flat zone 92, wherein, once again, the frictional engagement of the roller ball 66 within the follower 30 and the friction surface 72 of the motion control track 28 is very little, such that the trailing door panel 16 moves very little as the leading door panel 12 moves relative to the trailing door panel 16 toward the open position.

Finally, the first distal end 32 of the follower 30 then engages the second section 74B of the friction surface 72 within the opening track 36 that extends laterally outward toward the follower 30. The second section 74B extends laterally outward toward the follower 30 a second distance 80, and thus compresses the ball spring 68 and increases the frictional engagement between the roller ball 66 and the friction surface 72. The second distance 80 is greater than the first distance 78, thus the ball spring 68 is compressed more than when the follower engaged the first section 74A, and increases the frictional engagement between the roller ball 66 and the friction surface 72 more than when the follower 30 engaged the first section 74A. The increased frictional force reduces the amount of slippage between the roller ball 66 and the friction surface 72 and causes the trailing door panel 16 to be pushed toward the open position by the leading door panel 12, as the leading door panel 12 moves toward the open position. There is still slippage, so there is still relative motion between the leading door panel 12 and the trailing door panel 16, however, the relative motion between the leading door panel 12 and the trailing door panel 16 is reduced as compared to the relative motion between the leading door panel 12 and the trailing door panel 16 as the follower 30 passed through the first and second flat zones 90, 92 and the first section 74A.

As the leading door panel 12 and the trailing door panel 16 approach the fully open position, the first distal end 32 of the follower 30 is positioned within the opening track 36 of the motion control track 28 at a second position 94, as shown in FIG. 4. At this point, the first distal end 32 of the follower 30 engages the second ramped surface 62, wherein the first distal end 32 of the follower 30 is toggled over to the closing track 38 to a third position 96, as indicated by arrow 64, and the leading door panel 12 and the trailing door panel 16 are fully open, as shown in FIG. 3.

Referring to FIG. 3, as the leading door panel 12 is moved toward the closed position, as indicated by arrow 98, the leading door panel 12 moves relative to the trailing door panel 16. Referring to FIG. 4 and FIG. 8, as the leading door panel 12 moves relative to the trailing door panel 16 the first distal end 32 of the follower 30 moves within the closing track 38, as indicated by arrow 100. The first distal end 32 of the follower 30 engages the third section 76A of the friction surface 72 within the closing track 38 that extends laterally outward toward the follower 30. The third section 76A extends laterally outward toward the follower 30 a third distance 82, and thus compresses the ball spring 68 and increases the frictional engagement between the roller ball 66 and the friction surface 72. The increased frictional force reduces the amount of slippage between the roller ball 66 and the friction surface 72 and causes the trailing door panel 16 to be pulled toward the closed position by the leading door panel 12, as the leading door panel 12 moves toward the closed position. There is still slippage, so there is still relative motion between the leading door panel 12 and the trailing door panel 16, however, the relative motion between the leading door panel 12 and the trailing door panel 16 is reduced.

The first distal end 32 of the follower 30 then passes through a third flat zone 102, wherein, the frictional engagement of the roller ball 66 within the follower 30 and the friction surface 72 of the motion control track 28 is very little, such that the trailing door panel 16 moves very little as the leading door panel 12 moves relative to the trailing door panel 16 toward the closed position.

Finally, the first distal end 32 of the follower 30 then engages the fourth section 76B of the friction surface 72 within the closing track 38 that extends laterally outward toward the follower 30. The fourth section 76B extends laterally outward toward the follower 30 the third distance 82, and thus compresses the ball spring 68 and increases the frictional engagement between the roller ball 66 and the friction surface 72, just as within the third section 76A. The increased frictional force reduces the amount of slippage between the roller ball 66 and the friction surface 72 and causes the trailing door panel 16 to be pulled toward the closed position by the leading door panel 12, as the leading door panel 12 moves toward the closed position. There is still slippage, so there is still relative motion between the leading door panel 12 and the trailing door panel 16, however, the relative motion between the leading door panel 12 and the trailing door panel 16 is reduced as compared to the relative motion between the leading door panel 12 and the trailing door panel 16 as the follower 30 passed through the third flat zone 100.

As the leading door panel 12 and the trailing door panel 16 approach the fully closed position, the first distal end 32 of the follower 30 is positioned within the closing track 38 of the motion control track 28 at a fourth position 104, as shown in FIG. 4. At this point, the first distal end 32 of the follower 30 engages the first ramped surface 58, wherein the first distal end 32 of the follower 30 is toggled over to the opening track 36 to the first position 84, as indicated by arrow 60, and the leading door panel 12 and the trailing door panel 16 are fully open, as shown in FIG. 2.

Figure 9:
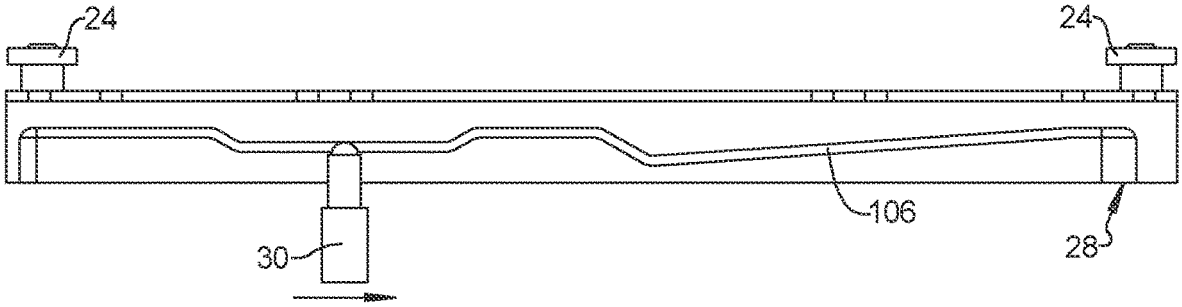
FIG. 9 is a sectional view similar to FIG. 8 illustrating a ramped section.

Each of the first, second, third and fourth sections 74A, 74B, 76A, 76B of the friction surface 72 that extend laterally outward toward the follower 30 may be flat and extend laterally outward toward the follower 30 a constant distance over an entire length, as shown in FIG. 7 and FIG. 8. This profile provides a constant frictional engagement over the entire length of the section 74A, 74B, 76A, 76B. Referring to FIG. 9, alternatively, one or more of the first, second, third and fourth sections 74A, 74B, 76A, 76B of the friction surface 72 that extend laterally outward toward the follower 30 may be a flat and ramped section 106 that extends laterally outward toward the follower a gradually varying distance over the entire length. This profile provides a gradually increasing or decreasing frictional engagement over the length of the section 106. A ramped section 106 can also provide a gradual reduction in the force needed to open or close the leading and trailing door panels 12, 16 by using the stored potential energy of the compressed ball spring 68 to follow a decreasing ramped surface 106 toward the open or closed position. Such an embodiment would reduce the force needed to continue movement of the leading and trailing door panels 12, 16 or even allow the leading and trailing door panels 12, 16 to continue moving without further applied force.

The first and second sections 74A, 74B of the friction surface 72 that extend laterally outward toward the follower 30 provide an opening profile for the leading door panel 12 and the trailing door panel 16 during opening of the leading door panel 12 and the trailing door panel 16. The third and fourth sections 76A, 76B of the friction surface 72 that extend laterally outward toward the follower 30 provide a closing profile for the leading door panel 12 and the trailing door panel 16 during closing of the leading door panel 12 and the trailing door panel 16. By varying the length of the sections 74A, 74B, 76A, 76B, 106 and the distances that each section 74A, 74B, 76A, 76B, 106 extends laterally outward, the opening profile and the closing profile can be uniquely tuned to obtain desired behavior of the multi-panel door 10 by controlling the relative motion of the leading and trailing door panels 12, 16 relative to one another while the leading and trailing door panels 12, 16 are being moved back and forth between the open and closed position.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. An indexing multi-panel door, comprising;

a leading door panel slidingly supported on a first track and moveable between an open position and a closed position;

a trailing door panel slidingly supported on a second track and moveable between an open position and a closed position;

a motion control track mounted to one of the leading door panel and the trailing door panel; and a follower mounted to and extending laterally from the other one of the leading door panel and the trailing door panel, the follower including a first distal end that is received within the motion control track and includes a spring biased roller ball that is spring biased laterally outward toward the motion control track, wherein the motion control track includes features adapted to frictionally engage the roller ball of the follower, wherein when the leading door panel is moved back and forth between the open position and the closed position, frictional engagement between the first distal end of the follower and features within the motion control track simultaneously:

moves the trailing door panel back and forth between the open and closed positions along with the leading door panel; and allows slippage between the first distal end of the follower and the features within the motion control track, wherein the leading door panel and the trailing door panel move relative to one another as the leading door panel and the trailing door panel are moved back and forth between the open and closed positions.

2. The indexing multi-panel door of claim 1, wherein the features of the motion control track are adapted to provide varying amounts of frictional engagement between the first distal end of the follower and the motion control track to allow movement of the trailing door panel relative to the leading door panel to be tuned to a specific profile as the leading door panel and the trailing door panel are moved back and forth between the open and closed positions.

3. The indexing multi-panel door of claim 2, wherein the motion control track includes a lateral facing friction surface, the spring biased roller ball of the first distal end of the follower engaging the friction surface and sliding across the friction surface as the leading door panel and the trailing door panel move relative to one another, the spring bias of the roller ball pushing the roller ball against the friction surface of the motion control track.

4. The indexing multi-panel door of claim 3, wherein the features within the motion control track comprise at least one section of the friction surface that extends laterally outward toward the follower, wherein when the first distal end of the follower slides across the at least one section of the friction surface, the spring biased roller ball is pushed laterally against the biasing force of the spring, increasing the force that the spring bias of the roller ball pushes the roller ball against the friction surface of the motion control track and reducing the amount of slippage between the follower and the motion control track and the movement of the leading door panel and the trailing door panel relative to one another as the leading door panel and the trailing door panel are moved back and forth between the open and closed positions.

5. The indexing multi-panel door of claim 4, wherein the at least one section is flat and extends laterally outward toward the follower a constant distance over an entire length of the at least one section, and frictional engagement of the first distal end of the follower with the friction surface within the at least one section provides a constant frictional engagement between the follower and the motion control track.

6. The indexing multi-panel door of claim 4, wherein the at least one section is flat and ramped, and frictional engagement of the first distal end of the follower with the friction surface within the at least one section provides a varying frictional engagement between the follower and the motion control track.

7. The indexing multi-panel door of claim 4, wherein the at least one section comprises a first section and a second section, the first section extending laterally outward toward the follower a first distance and the second section extending laterally outward toward the follower a second distance, that is greater than the first distance.

8. The indexing multi-panel door of claim 4, wherein the motion control track includes an opening track and a closing track, wherein the first distal end of the follower engages the opening track of the motion control track during opening of the leading door panel and the trailing door panel, and the first distal end of the follower engages the closing track of the motion control track during closing of the leading door panel and the trailing door panel.

9. The indexing multi-panel door of claim 8, wherein the follower includes an over-center feature adapted to:

allow the first distal end of the follower to toggle from the closing track to the opening track when the leading door panel and the trailing door panel are completely closed;

keep the first distal end of the follower engaged with the opening track during opening of the leading door panel and the trailing door panel;

allow the first distal end of the follower to toggle from the opening track to the closing track when the leading door panel and the trailing door panel are completely open; and keep the first distal end of the follower engaged with the closing track during closing of the leading door panel and the trailing door panel.

10. The indexing multi-panel door of claim 9, wherein the opening track and the closing track are parallel to and adjacent one another, the closing track including a first ramped surface that forces the first distal end of the follower to toggle to the opening track when the leading door panel and the trailing door panel are moved to the closed position, and the opening track including a second ramped surface that forces the first distal end of the follower to toggle to the closing track when the leading door panel and the trailing door panel are moved to the open position.

11. The indexing multi-panel door of claim 10, wherein the features within the motion control track comprise at least one section of the friction surface that extends laterally outward toward the follower within the opening track and at least one section of the friction surface that extends laterally outward toward the follower within the closing track.

12. The indexing multi-panel door of claim 11, wherein the at least one section of the friction surface within the opening track provides an opening profile for the leading door panel and the trailing door panel during opening of the leading door panel and the trailing door panel, and the at least one section of the friction surface within the closing track provides a closing profile for the leading door panel and the trailing door panel during closing of the leading door panel and the trailing door panel.

13. An indexing multi-panel door, comprising a leading door panel slidingly supported on a first track and moveable between an open position and a closed position;

a trailing door panel slidingly supported on a second track and moveable between an open position and a closed position;

a motion control track mounted to one of the leading door panel and the trailing door panel, the motion control track including an opening track and a closing track;

a follower mounted to and extending laterally from the other one of the leading door panel and the trailing door panel, the follower including a first distal end that is received within the opening track of the motion control track during opening of the leading door panel and the trailing door panel, and is received within the closing track of the motion control track during closing of the leading door panel and the trailing door panel;

each of the opening track and the closing track including features adapted to frictionally engage the first distal end of the follower, wherein when the leading door panel is moved back and forth between the open position and the closed position, frictional engagement between the first distal end of the follower and features within the motion control track simultaneously:

moves the trailing door panel back and forth between the open and closed positions along with the leading door panel; and allows slippage between the first distal end of the follower and the features within the opening track and the closing track, wherein the leading door panel and the trailing door panel move relative to one another as the leading door panel and the trailing door panel are moved back and forth between the open and closed position; and wherein the follower includes an over-center feature adapted to:

allow the first distal end of the follower to toggle from the closing track to the opening track when the leading door panel and the trailing door panel are completely closed;

keep the first distal end of the follower engaged with the opening track during opening of the leading door panel and the trailing door panel;

allow the first distal end of the follower to toggle from the opening track to the closing track when the leading door panel and the trailing door panel are completely open; and keep the first distal end of the follower engaged with the closing track during closing of the leading door panel and the trailing door panel.

14. The indexing multi-panel door of claim 13, wherein the features of the opening track and the closing track are adapted to provide varying amounts of frictional engagement between the first distal end of the follower and the opening track and the closing track to allow movement of the trailing door panel relative to the leading door panel to be tuned to a specific profile as the leading door panel and the trailing door panel are moved back and forth between the open and closed positions.

15. The indexing multi-panel door of claim 14, wherein the opening track and the closing track are parallel to and adjacent one another, the closing track including a first ramped surface that forces the first distal end of the follower to toggle to the opening track when the leading door panel and the trailing door panel are moved to the closed position, and the opening track including a second ramped surface that forces the first distal end of the follower to toggle to the closing track when the leading door panel and the trailing door panel are moved to the open position.

16. The indexing multi-panel door of claim 15, wherein the first distal end of the follower includes a spring biased roller ball, wherein the roller ball is spring biased laterally outward toward the motion control track.

17. The indexing multi-panel door of claim 16, wherein the motion control track includes a lateral facing friction surface, the spring biased roller ball of the first distal end of the follower engaging the friction surface and sliding across the friction surface as the leading door panel and the trailing door panel move relative to one another, the spring bias of the roller ball pushing the roller ball against the friction surface of the motion control track.

18. The indexing multi-panel door of claim 17, wherein the features within the motion control track comprise at least one section of the friction surface within the opening track that extends laterally outward toward the follower and at least one section of the friction surface within the closing track that extends laterally outward toward the follower, wherein:

when the first distal end of the follower slides across the at least one section of the friction surface within the opening track, the spring biased roller ball is pushed laterally against the biasing force of the spring, increasing the force that the spring bias of the roller ball pushes the roller ball against the friction surface of the opening track and reducing the amount of slippage between the follower and the motion control track and the movement of the leading door panel and the trailing door panel relative to one another as the leading door panel and the trailing door panel move toward the open positions; and when the first distal end of the follower slides across the at least one section of the friction surface within the closing track, the spring biased roller ball is pushed laterally against the biasing force of the spring, increasing the force that the spring bias of the roller ball pushes the roller ball against the friction surface of the closing track and reducing the amount of slippage between the follower and the motion control track and the movement of the leading door panel and the trailing door panel relative to one another as the leading door panel and the trailing door panel move toward the closed positions.

19. The indexing multi-panel door of claim 18, wherein each of the at least one section of the friction surface within the opening track and each of the at least one section of the friction surface within the closing track is one of:

flat and extends laterally outward toward the follower a constant distance over an entire length and providing a constant frictional engagement over the entire length; and flat and ramped, extending laterally outward toward the follower a gradually varying distance over the entire length and providing a varying frictional engagement over the entire length.

20. The indexing multi-panel door of claim 19, wherein the at least one section of the friction surface within the opening track provides an opening profile for the leading door panel and the trailing door panel during opening of the leading door panel and the trailing door panel, and the at least one section of the friction surface within the closing track provides a closing profile for the leading door panel and the trailing door panel during closing of the leading door panel and the trailing door panel.

* * * * *